US008208823B2

(12) United States Patent
Yoshioka

(10) Patent No.: US 8,208,823 B2
(45) Date of Patent: Jun. 26, 2012

(54) TRANSFER DEVICE AND IMAGE FORMING APPARATUS

(75) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 563 days.

(21) Appl. No.: 12/414,813

(22) Filed: Mar. 31, 2009

(65) Prior Publication Data

US 2010/0080589 A1 Apr. 1, 2010

(30) Foreign Application Priority Data

Sep. 26, 2008 (JP) ..... 2008-247621

(51) Int. Cl.
*G03G 15/00* (2006.01)
*G03G 15/01* (2006.01)
*G03G 15/16* (2006.01)

(52) U.S. Cl. ..... 399/45; 399/66; 399/302

(58) Field of Classification Search ..... 399/45, 399/66, 302
See application file for complete search history.

(56) References Cited

U.S. PATENT DOCUMENTS

2004/0126125 A1* 7/2004 Yoda et al. ..... 399/45
2005/0280687 A1* 12/2005 Kurahashi ..... 399/45 X
2008/0075479 A1* 3/2008 Genda ..... 399/23
2008/0317518 A1* 12/2008 Fukuhara ..... 399/302
2009/0060540 A1* 3/2009 Matsushita et al. ..... 399/45

FOREIGN PATENT DOCUMENTS

JP 2005-208403 8/2005

* cited by examiner

*Primary Examiner* — Sophia S Chen
(74) *Attorney, Agent, or Firm* — Morgan, Lewis & Bockius LLP

(57) ABSTRACT

A transfer device includes: a first transfer unit that transfers a developer image formed on an image carrier to an intermediate transfer member; a second transfer unit that transfers the developer image on the intermediate transfer member to a recording medium; and a control unit that controls at least one of a transfer pressure and a transfer electric field by the first transfer unit in accordance with a type of the recording medium to which the developer image is transferred.

14 Claims, 12 Drawing Sheets

FIG. 9

| GRADE | CONDITION OF DROPOUTS IN IMAGE |
|---|---|
| G 1 | INDENTATIONS SLIGHTLY PALE |
| G 2 | INDENTATIONS SLIGHTLY WHITENED |
| G 3 | INDENTATIONS WHITENED |

TRANSFER DEVICE AND IMAGE FORMING APPARATUS

CROSS-REFERENCE TO RELATED APPLICATION

This application is based on and claims priority under 35 USC 119 from Japanese Patent Application No. 2008-247621 filed Sep. 26, 2008.

BACKGROUND

1. Technical Field

The present invention relates to a transfer device and an image forming apparatus.

2. Related Art

In an image forming apparatus, during transfer of a toner image to a recording medium on a surface of which protrusions have been mechanically formed, for example, embossed paper or the like, a transfer electric field at flat portions is lower than a transfer electric field at protrusions.

SUMMARY

A transfer device of an aspect of the present invention includes: a first transfer unit that transfers a developer image formed on an image carrier to an intermediate transfer member; a second transfer unit that transfers the developer image on the intermediate transfer member to a recording medium; and a control unit that controls at least one of a transfer pressure or a transfer electric field by the first transfer unit in accordance with a type of the recording medium to which the developer image is transferred.

BRIEF DESCRIPTION OF THE DRAWINGS

Exemplary embodiments of the invention will be described in detail with reference to the following figures, wherein:

FIG. 9 is a table of image deletion grades of images at embossed paper.

DETAILED DESCRIPTION

Figure 1:
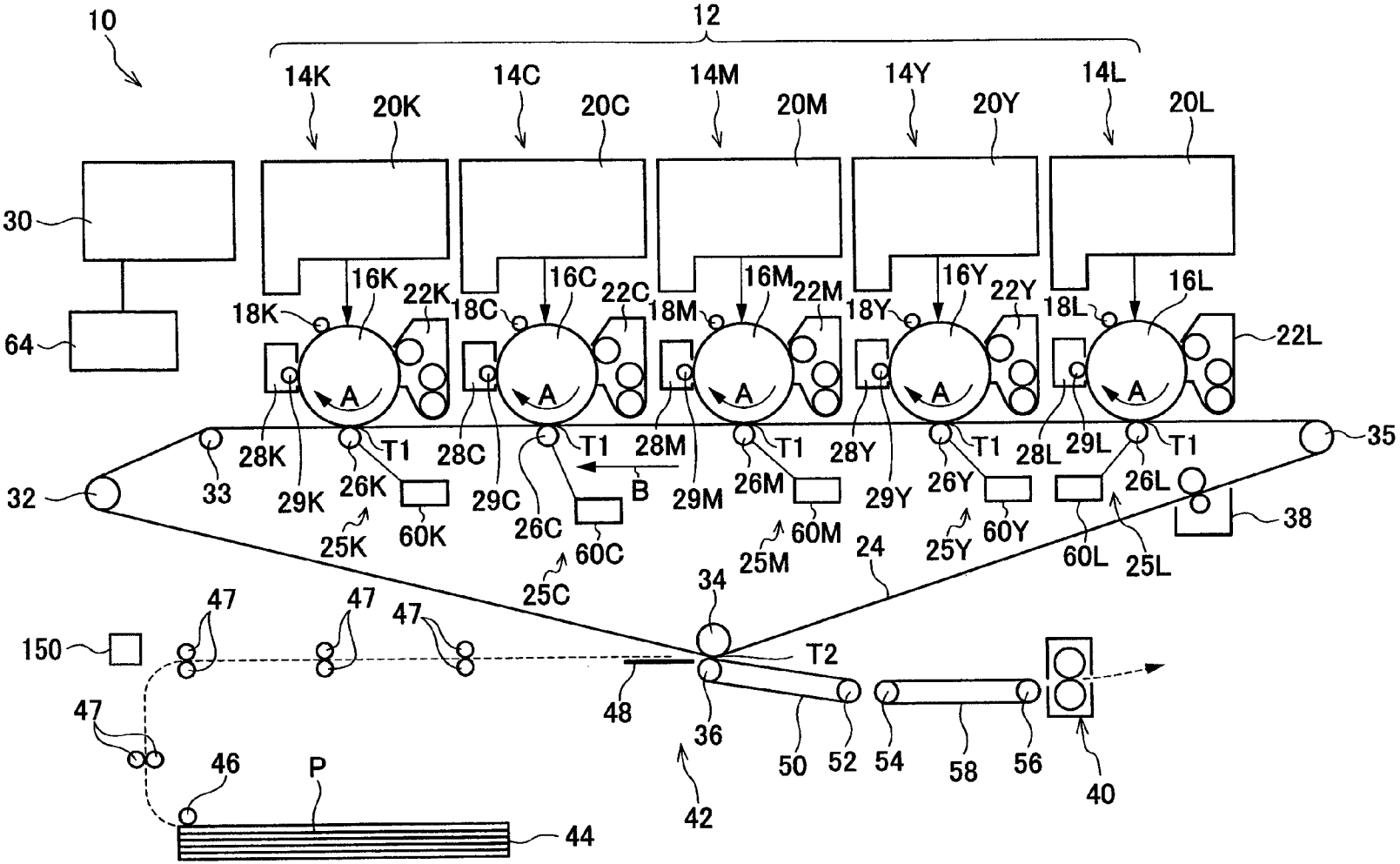
FIG. 1 is a schematic structural diagram illustrating structure of an image forming apparatus of a first exemplary embodiment of the present invention.

First Exemplary Embodiment herebelow, exemplary embodiments of the present invention will be described in detail in accordance with the drawings. Herein, components that are common to each of colors are described with letters representing the colors appended to the reference numerals. In FIG. 2A to FIG. 4C, the letters representing the colors are omitted for the components that are common to each color.

Firstly, structure of an image forming apparatus 10 of the present exemplary embodiment is described. As shown in FIG. 1, the image forming apparatus 10 includes a five-stage tandem-type image forming section 12 that transfers a toner image (an example of a developer image) of each of colors based on inputted image data to an endless belt-form intermediate transfer belt 24, which will be described later, and forms a full-color toner image.

The image forming section 12 includes electrophotography-system image forming units 14L, 14Y, 14M, 14C and 14K, which output images of the colors clear (L), yellow (Y), magenta (M), cyan (C) and black (K), in this order from an upstream side of a transporting direction of recording paper P. The image forming units 14L to 14K are arranged along a direction of movement of the intermediate transfer belt 24 (shown by arrow B), with predetermined separation distances from one another.

The image forming units 14L to 14K include photosensitive drums 16L to 16K, which serve as image carriers. The photosensitive drums 16L to 16K are structured by layering a photosensitive layer constituted with an organic photoconductive body or the like on a surface (peripheral face) of a cylindrical body made of conductive metal. The photosensitive drums 16L to 16K are driven to turn at a predetermined process speed in the direction of arrow A in the drawings (the clockwise direction).

This photosensitive layer is a separated-function form, in which a charge generation layer and a charge transport layer are sequentially laminated. The photosensitive layer has the property that ordinarily resistance is high but, when laser beam is illuminated thereon, the resistivity of a portion that is illuminated with laser beam changes.

Charging units 18L to 18K, exposure devices 20L to 20K, developing apparatuses 22L to 22K, the endless belt-form intermediate transfer belt 24, first transfer devices 25L to 25K and cleaning devices 28L to 28K are disposed around the respective photosensitive drums 16L to 16K in this order from a rotation direction upstream side. The charging units 18L to 18K are electrostatic charging devices that uniformly charge the surfaces (peripheral faces) of the photosensitive drums 16L to 16K to a predetermined potential. The exposure devices 20L to 20K illuminate laser beams (exposure beams) on the surfaces (peripheral faces) of the uniformly charged photosensitive drums 16L to 16K in accordance with color-separated image data (image signals), and form electrostatic latent images with the exposure beams. The developing devices 22L to 22K transfer charged toner (an example of a developing agent) to the electrostatic latent images (i.e., develop the images) to form toner images. The intermediate transfer belt 24 turnably extends along a path touching against the photosensitive drums 16L to 16K. The first transfer devices 25L to 25K are transfer devices that transfer the toner images formed on the photosensitive drums 16L to 16K to the intermediate transfer belt 24. The cleaning devices 28L to 28K remove transfer residue toner that is left on the surfaces of the photosensitive drums 16L to 16K after the transfer.

Brush rollers 29L to 29K are provided at the cleaning devices 28L to 28K. The brush rollers 29L to 29K press and contact to the surfaces (peripheral faces) of the photosensitive drums 16L to 16K, are driven to rotate in the opposite direction to the direction of rotation of the photosensitive drums 16L to 16K (the direction of arrow A), and scrape off transfer residue toner from the photosensitive drums 16L to 16K.

The first transfer devices 25L to 25K are disposed at the inner side of the intermediate transfer belt 24, at positions respectively opposing the photosensitive drums 16L to 16K. The first transfer devices 25L to 25K are provided with first transfer rollers 26L to 26K, respectively. The first transfer rollers 26L to 26K press the intermediate transfer belt 24 against the photosensitive drums 16L to 16K. Herein, portions of contact between the photosensitive drums 16L to 16K and the intermediate transfer belt 24 that are caused by the first transfer rollers 26L to 26K serve as first transfer portions (first transfer positions) T1.

The first transfer devices 25L to 25K are further provided with first transfer bias power supplies 60L to 60K, respectively, which apply a first transfer bias to the first transfer rollers 26L to 26K. The first transfer bias power supplies 60L to 60K are controlled by a control unit 30 that serves as a control component, and may alter the first transfer biases that are applied to the first transfer rollers 26L to 26K.

Here, the charging units 18L to 18K shown in the drawing are formed as roller-form contact chargers, but non-contact chargers may be used, such as scorotrons, solid state chargers or the like.

The intermediate transfer belt 24, which serves as an intermediate transfer member, is entrained around the first transfer rollers 26L to 26K, a driving roller 32 that is driven to rotate by an unillustrated drive source, a tension roller 33 that adjusts tension of the intermediate transfer belt 24, a backup roller 34 that is disposed at a second transfer portion (second transfer position) T2, which will be described later, and a driven roller 35. The intermediate transfer belt 24 is driven so as to turn (is circulated) in the direction of arrow B synchronously with rotation of the photosensitive drums 16.

In this intermediate transfer belt 24, for example, a material for providing conductivity, such as carbon, an ion conduction material or the like, is dispersed in a resin material, such as a polyimide, polyamideimide, polycarbonate, fluorine-based resin or the like.

A second transfer roller 36, which serves as a second transfer unit, is provided at a position opposing the backup roller 34 and sandwiching the intermediate transfer belt 24 therebetween. The second transfer roller 36 transfers a toner image on the intermediate transfer belt 24 onto recording paper P that is being transferred by a transferring mechanism 42, which will be described later. A later-described first transferring belt 50 is entrained around the second transfer roller 36. A portion of contact between the second transfer roller 36 and the intermediate transfer belt 24, with the first transferring belt 50 therebetween, serves as the second transfer portion (second transfer position) T2. In the present exemplary embodiment, the transfer device is constituted by the first transfer devices 25L to 25K, the second transfer roller 36 and the control unit 30.

The image forming apparatus 10 is further provided with a toner removal device 38 and a fixing device 40. The toner removal device 38 removes transfer residue toner that is left on the intermediate transfer belt 24 after the toner image has been transferred onto the recording paper P by the second transfer roller 36. The fixing apparatus 40 serves as a fixing section that fixes the toner image that has been transferred onto the recording paper P by the second transfer roller 36.

The transferring mechanism 42 is constituted by a pickup roller 46, pairs of transferring rollers 47, a guide member 48, the first transferring belt 50, a second transferring belt 58, a paper ejection tray (not shown in the drawings) and such like. The pickup roller 46 transports the recording paper P accommodated in a paper supply tray 44 one sheet at a time. The pairs of transferring rollers 47 are plurally provided (four in the illustration) on a transport path of the recording paper P. The guide member 48 provides the recording paper P to the second transfer portion (second transfer position) T2. The first transferring belt 50 is entrained around the second transfer roller 36 and a guide roller 52. The second transferring belt 58 is disposed at the downstream side of the transport path of the recording paper P relative to the first transferring belt 50, and is entrained around guide rollers 54 and 56. The paper ejection tray is provided at the downstream side of the fixing device 40.

With this structure, the recording paper P accommodated in the paper supply tray 44 is transferred by the transferring mechanism 42 to the second transfer portion (second transfer position) T2 at which the second transfer roller 36 (the first transferring belt 50) and the backup roller 34 oppose one another sandwiching the intermediate transfer belt 24. The recording paper P is transferred from the second transfer portion (second transfer position) T2 to the fixing device 40, and is transferred from the fixing device 40 to the paper ejection tray.

Next, the first transfer devices 25L to 25K will be described in detail. Here, given that the image forming units 14L to 14K of the respective colors have substantially the same structure, the first transfer device 25Y of the image forming unit 14Y will be described in detail as a representative. Upward and downward directions in the descriptions indicate directions for a case in which the photosensitive drums 16L to 16K illustrated in FIG. 1 to FIG. 4 are above and the first transfer devices 25L to 25K are below. In a case in which the photosensitive drums 16L to 16K and the first transfer devices 25L to 25K do not have an upward/downward relationship, "above" and "below" may equally be read as "photosensitive drum side" and "first transfer device side".

Figure 2B:
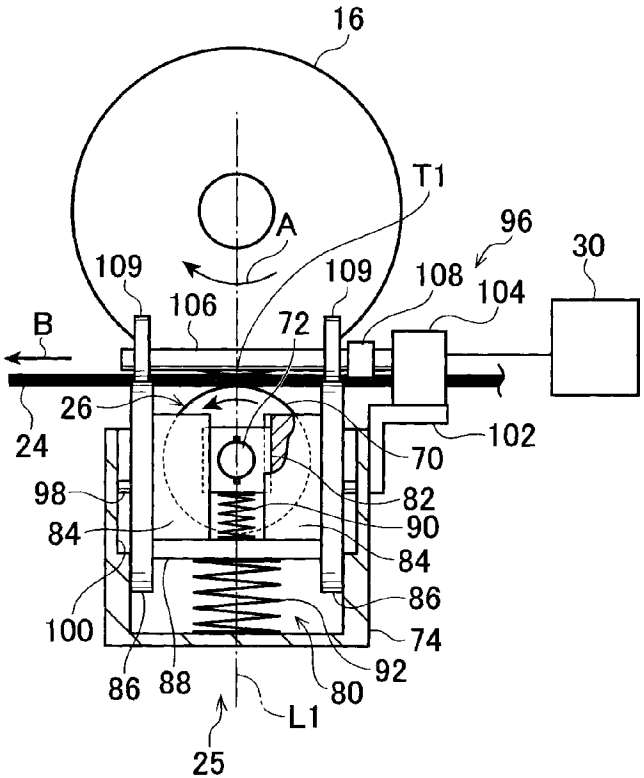
FIG. 2B is a partial sectional side view in which the transfer device of FIG. 2A is viewed from a side.
Figure 2A:
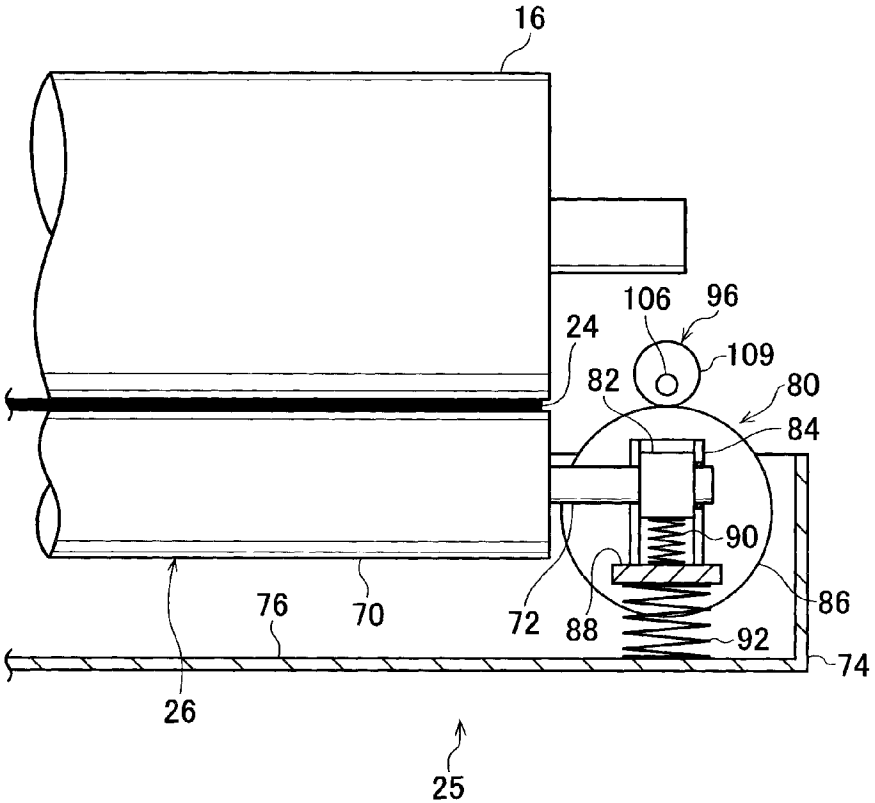
FIG. 2A is a partial sectional front view in which a first state of a transfer device of the first exemplary embodiment of the present invention is viewed from the front.

As shown in FIG. 2A and FIG. 2B, the first transfer device 25Y includes the first transfer roller 26Y, the first transfer bias power supply 60Y, a housing 74Y and urging mechanisms 80Y. The first transfer roller 26Y includes a roller main body 70Y, and an axle portion 72Y that extends from the roller main body 70Y to the outside at both ends along an axial direction. The first transfer roller 26Y is accommodated in the rectangular box-form housing 74Y, which is provided at a position opposing the photosensitive drum 16Y (below the photosensitive drum in the illustrations), sandwiching the intermediate transfer belt 24. An upper face of this housing 74Y is open, and the first transfer roller 26Y can be moved in and out through this opening.

The urging mechanisms 80Y are respectively attached to a floor face 76Y at the inner side of the housing 74Y, at positions corresponding with the axle portions 72Y of the first transfer roller 26Y, and urge the first transfer roller 26Y upward. The urging mechanisms 80Y urge the first transfer roller 26Y upward to press the intermediate transfer belt 24 against the photosensitive drum 16Y. The urging force on the first transfer roller 26Y may be adjusted. Below, details of the urging mechanisms 80Y will be described.

Each urging mechanism 80Y is provided with a bearing 82Y, a pair of guide rails 84Y, a pair of round plates 86Y, a base 88Y, a first coil spring 90Y, a second coil spring 92Y and a movement mechanism 96Y. The bearing 82Y turnably supports the axle portion 72Y of the first transfer roller 26Y. The guide rails 84Y guide vertical direction movements of the bearing 82Y. The pair of round plates 86Y are attached one to each of the pair of guide rails 84Y. The base 88Y connects between the pair of round plates 86Y. The first coil spring 90Y is disposed between the base 88Y and the bearing 82Y, and urges the bearing 82Y upward. The second coil spring 92Y is disposed between the base 88Y and the floor face 76Y, and urges the base 88Y upward. The movement mechanism 96Y moves the round plates 86Y in the vertical direction.

The bearing 82Y is formed in a substantially rectangular parallelopiped shape. Two sides of the bearing 82Y are inserted into the pair of letter U-like shape guide rails 84Y, respectively, and are slidable. Specifically, the bearing 82Y is in a state in which the two side face portions thereof fit into the recess portions of the U shapes of the guide rails 84Y. A stopper pin is inserted into an end portion of the axle portion 72Y. Thus, shifting of the first transfer roller 26Y in the axial direction is suppressed.

The guide rails 84Y extend in the vertical direction. Rear faces of the guide rails 84Y are attached to the pair of round plates 86Y, and lower end portions thereof touch against the upper face of the plate-like base 88Y. The upper face of the base 88Y is substantially parallel with the intermediate transfer belt 24.

A portion at one end of the first coil spring 90Y is attached to the lower face of the bearing 82Y, and a portion at the other end is attached to the upper face of the base 88Y. The first coil spring 90Y is disposed such that, as viewed in the direction of illustration of FIG. 2B (the side view), the central axis of the first coil spring 90Y coincides with a straight line L1 which extends in the diametric direction of the photosensitive drum 16Y (here, a straight line passing through the center of the photosensitive drum 16Y and the center of the first transfer roller 26Y).

A portion at one end of the second coil spring 92Y is attached to the lower face of the base 88Y, and a portion at the other end is attached to the upper face of the floor face 76Y. The second coil spring 92Y is disposed such that, as viewed in the direction of illustration of FIG. 2B (the side view), the central axis coincides with the straight line L1 that extends in the diametric direction of the photosensitive drum 16Y, similarly to the first coil spring 90Y.

The movement mechanism 96Y includes circular rod-form protrusions 98Y, guide grooves 100Y, a stepper motor 104Y, an extended shaft 106Y and a pair of cams 109Y. The protrusions 98Y are disposed at the outer faces of the round plates 86Y. The guide grooves 100Y are disposed at positions of inner wall faces of the housing 74Y that correspond with the protrusions 98Y, and guide movement of the inserted protrusions 98Y in the vertical direction. The stepper motor 104Y is attached to an upper face of a pedestal 102Y with substantially an inverted L shape, of which one part is fixed to an outer wall face of the housing 74Y. The extended shaft 106Y is an extension of a rotation shaft of the stepper motor 104Y. The cams 109Y are provided on the extended shaft 106Y and cause the pair of round plates 86Y to move in the vertical direction.

Specifically, the stepper motor 104Y is joined to the extended shaft 106Y via a coupling 108Y at the rotation shaft thereof, and is attached to an upper face of the pedestal 102Y such that the extended shaft 106Y is parallel with axial directions of the pair of round plates 86Y, while passing above the pair of round plates 86Y. The pair of cams 109Y are disposed such that outer peripheral faces thereof abut against outer peripheral faces of the pair of round plates 86Y.

Figure 3B:
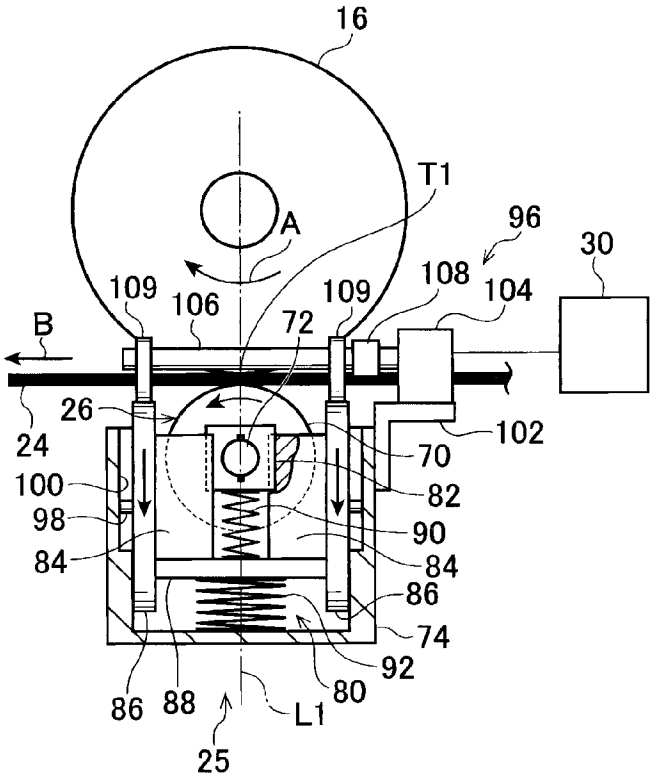
FIG. 3B is a partial sectional side view in which the transfer device of FIG. 3A is viewed from the side.
Figure 3A:
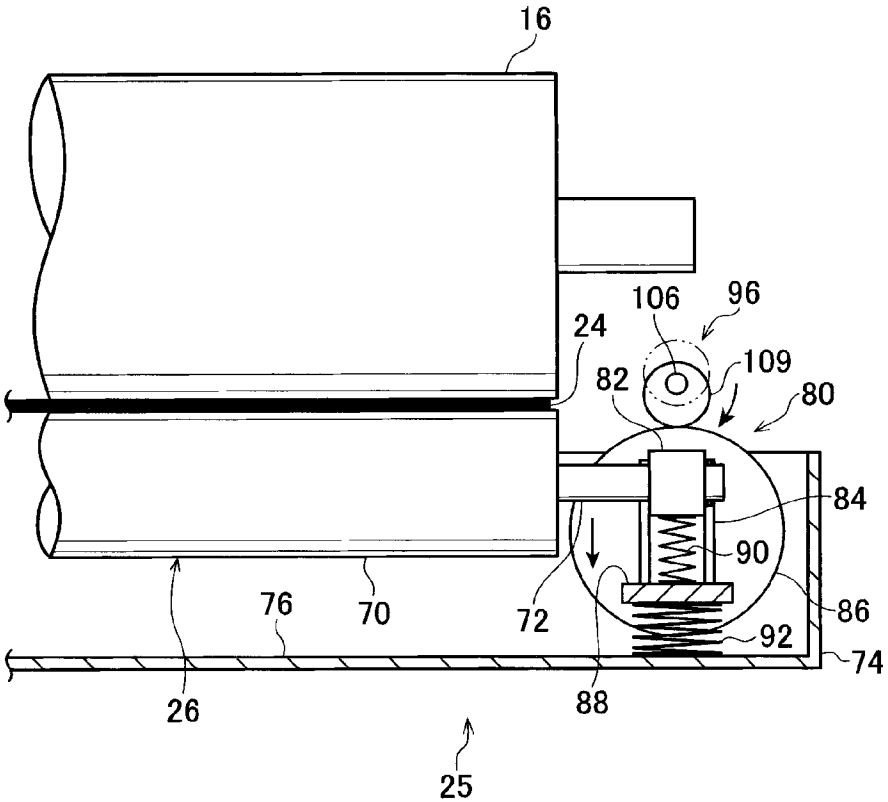
FIG. 3A is a partial sectional front view in which a second state of the transfer device of the first exemplary embodiment of the present invention is viewed from the front.

Now, an operation will be described in which the first transfer device 25Y switches, from a first state which is shown in FIG. 2A and FIG. 2B to a second state which is shown in FIG. 3A and FIG. 3B, receiving a control signal from the control section 30.

Figure 4A:
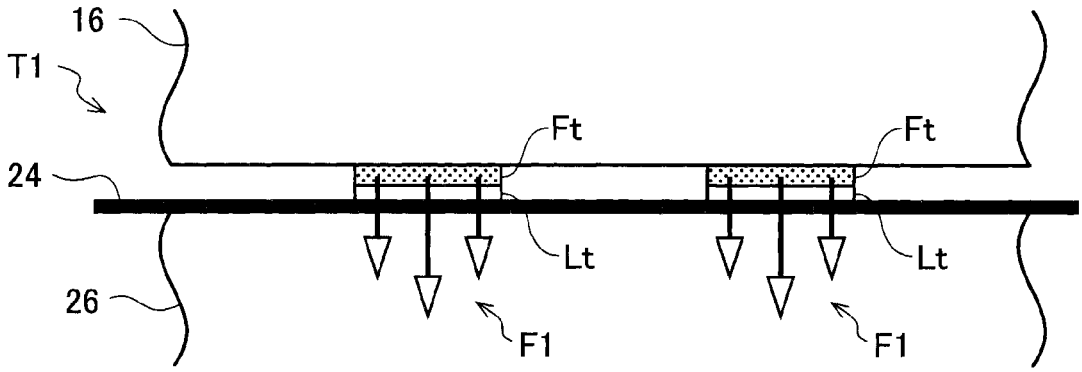
FIG. 4A is an enlarged view of a first transfer section in a state in which toner is being transferred from a photosensitive drum to an intermediate transfer belt.

When the stepper motor 104Y receives a control signal from the control section 30 for switching the first transfer device 25Y from the first state to the second state, the stepper motor 104Y starts to turn. Accordingly, the cams 109Y turn, and the pair of round plates 86Y are pushed downward by the protruding sides of the cams 109Y (the sides thereof with a greater distance from the extended shaft 106Y). At this time, the base 88Y moves together with the pair of round plates 86Y, and the second coil spring 92Y disposed between the base 88Y and the floor face 76Y is compressed. At this time, although the base 88Y is moving downward, the first coil spring 90Y urges the first transfer roller 26Y upward, but a force with which the intermediate transfer belt 24 presses against the photosensitive drum 16Y (a transfer pressure) is made lower than when in the first state. Thus, when the first transfer device 25Y is in the second state, the pressing force is lower than when in the first state, and an adhesion force F1 of toner that is transferred onto the intermediate transfer belt 24 (a toner image) is also lowered. As shown in FIG. 4A, the adhesion force F1 of the toner is stronger at the middle portion than at edge portions.

As shown in FIG. 1, an operation panel 64 is provided at the image forming apparatus 10. When a type of recording paper P on which an image is to be formed is inputted through the operation panel 64, the control section 30 reads particular information corresponding to that type of recording paper P (size, type, basis weight and the like), which is pre-memorized in a built-in non-volatile memory, and implements various kinds of control at the image forming apparatus 10. Now, if the type of recording paper P corresponds to an embossed paper EP, at whose surface protrusions have been mechanically processed (formed), the control section 30 sends a control signal to the stepper motor 104Y to put the first transfer device 25Y into the second state. When the type of recording paper P corresponds to usual paper, whose surface is smoother than the embossed paper EP, the control section 30 sends a control signal to the stepper motor 104Y to put the first transfer device 25Y into the first state.

When the first transfer device 25Y is to be switched from the second state to the first state, the stepper motor 104Y is turned forward or backward until the state illustrated in FIG. 2A and FIG. 2B is reached.

Next, operation of the image forming apparatus 10 is described. Given that the image forming units 14L to 14K of the respective colors have substantially the same structure, operations for forming a yellow toner image with the image forming unit 14Y will be described. Before the yellow toner image is transferred onto the intermediate transfer belt 24, a clear toner image has already been transferred onto the intermediate transfer belt 24 by the image forming unit 14L. Here, the type of the recording paper P is usual paper, and the type of the recording paper P has already been inputted through the operation panel 64.

First, the surface of the photosensitive drum 16Y is uniformly charged to a negative potential by the charging unit 18Y. Laser beam is illuminated at the uniformly charged surface of the photosensitive drum 16Y by the exposure device 20Y, in accordance with image data for yellow that is sent from the control section 30. Thus, an electrostatic latent image of a yellow printing pattern is formed at the photosensitive layer of the photosensitive drum 16Y.

The electrostatic latent image is an image formed of static electricity on the surface (the photosensitive layer) of the photosensitive drum 16Y. In the photosensitive layer, resistivity of portions at which the laser beam is illuminated is lowered, and the charge that has been charged flows to the surface of the photosensitive drum 16Y, while charge at portions at which the laser beam is not illuminated is remained. Thus, an electrostatic latent image, which is referred to as a negative latent image, is formed.

The electrostatic latent image formed on the photosensitive drum 16Y in this manner is transferred to a predetermined development position by rotation of the photosensitive drum 16Y. Then, at the development position, the electrostatic latent image on the photosensitive drum 16Y is made into a visible image (a toner image) by the developing device 22Y. A yellow toner accommodated inside the developing device 22Y includes, for example, at least a yellow colorant and a binding resin, with a volume average particle diameter in the range of 3 μm to 6 μm.

The yellow toner is frictionally charged by agitation within the developing device 22Y, and has the same polarity (negative) as the electrostatic charge on the surface of the photosensitive drum 16Y. Therefore, when the surface of the photosensitive drum 16Y proceeds to pass the developing device 22Y, the yellow toner electrostatically adheres only to the latent image portion at which the surface of the photosensitive drum 16Y has been discharged, and the latent image is developed with the yellow toner. Thereafter, the photosensitive drum 16Y continues to turn, and the yellow toner image developed on the surface thereof is transferred to the first transfer portion (first transfer position) T1.

When the yellow toner image on the surface of the photosensitive drum 16Y is transferred to the first transfer portion (first transfer position) T1, the predetermined first transfer bias is applied from the first transfer bias power supply 60Y to the first transfer roller 26Y, a transfer electric field is formed, and electrostatic force from the photosensitive drum 16Y toward the first transfer roller 26Y acts on the toner image. Hence, because the first transfer roller 26Y is pressing, by the urging mechanism 80Y, the intermediate transfer belt 24 against the photosensitive drum 16Y, the yellow toner image on the surface of the photosensitive drum 16Y is transferred onto the surface of the intermediate transfer belt 24. At this time, the applied first transfer bias is the opposite polarity (positive) to the polarity of the toner (negative), and constant current control at the image forming unit 14Y is performed by the control section 30.

Transfer residue toner on the surface of the photosensitive drum 16Y is cleaned off by the cleaning device 28Y. First transfer biases applied to the first transfer rollers 26L and 26M to 26K of the image forming units 14L and 14M to 14K are controlled in the same manner as described above. Thus, the intermediate transfer belt 24 to which the yellow toner image has been transferred at the image forming unit 14Y is sequentially transferred to the image forming units 14M to 14K of the remaining colors, and the toner images of the respective colors are transferred so as to be superposed (multiple superposedly transferred).

The intermediate transfer belt 24 that has passed each of the image forming units 14L to 14K, and had toner images of all the colors multiple superposedly transferred thereon, turns to transfer the images in the direction of arrow B in the drawing, and reaches the second transfer portion (second transfer position) T2. The second transfer portion (second transfer position) T2 is configured by the backup roller 34, which touches against the inner face (rear face) of the intermediate transfer belt 24, and the second transfer roller 36 (the first transferring belt 50) disposed at the side of the image holding face of the intermediate transfer belt 24.

Meanwhile, the recording paper P is supplied to between the second transfer roller 36 (the first transferring belt 50) and the intermediate transfer belt 24 at a predetermined time by the transferring mechanism 42, and the predetermined second transfer bias is applied to the second transfer roller 36. The second transfer bias that is applied at this time is the opposite polarity (positive) to the polarity of the toner (negative). Electrostatic force from the intermediate transfer belt 24 toward the recording paper P acts on the toner image, and the toner image on the surface of the intermediate transfer belt 24 is transferred onto the surface of the recording paper P.

The second transfer bias at this time is determined on the basis of a resistance detected by a resistance detection unit (not illustrated), which detects resistance at the second transfer portion (second transfer position) T2, and controlled with a constant voltage. After at the second transfer portion (second transfer position) T2, the recording paper P is fed into the fixing device 40, the toner image is heated and pressured, and the multiplecolor-superposed (multiple superposedly transferred) toner image is fused and permanently fixed to the surface of the recording paper P. Hence, the recording paper P (ordinary paper) for which fixing of a full-color image has been completed is transferred to the ejection tray, and a sequence of full-color image formation operations is complete.

Now, a case in which the type of the recording paper P inputted at the operation panel 64 is the embossed paper EP will be described. Operations of the respective units of the image forming apparatus 10 are substantially the same as in the case in which the type of the recording paper P is ordinary paper.

In the case in which the type of the recording paper P inputted at the operation panel 64 corresponds to the embossed paper EP, the control section 30 switches the first transfer devices 25L to 25K from the first state into the second state. Hence, as shown in FIG. 4A, the respective toner images formed on the photosensitive drums 16L to 16K are transferred onto the intermediate transfer belt 24. Here, pressing forces (transfer pressures) on the intermediate transfer belt 24 at the first transfer portions T1 are lower when the first transfer devices 25L to 25K are in the second state than when in the first state. Therefore, the adhesion force F1 of a toner image onto the intermediate transfer belt 24 is lowered. The reference symbol Lt in FIG. 4A to FIG. 4C indicates the clear toner (transparent toner), and the reference symbol Ft indicates the colored toners of yellow, magenta, cyan and black.

Figure 4B:
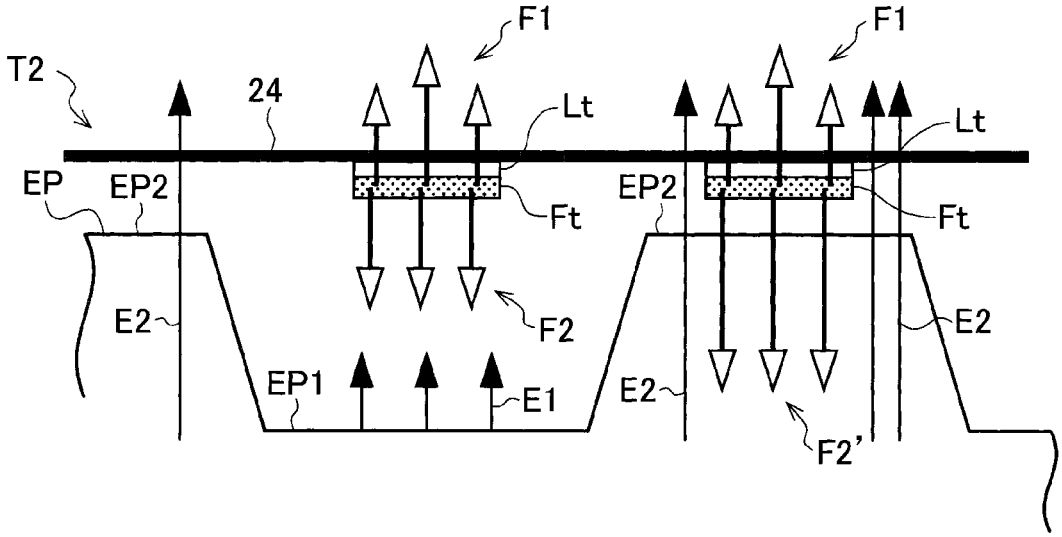
FIG. 4B is an enlarged view of a second transfer section, for describing force that acts when toner is being transferred from the intermediate transfer belt to embossed paper.
Figure 4C:
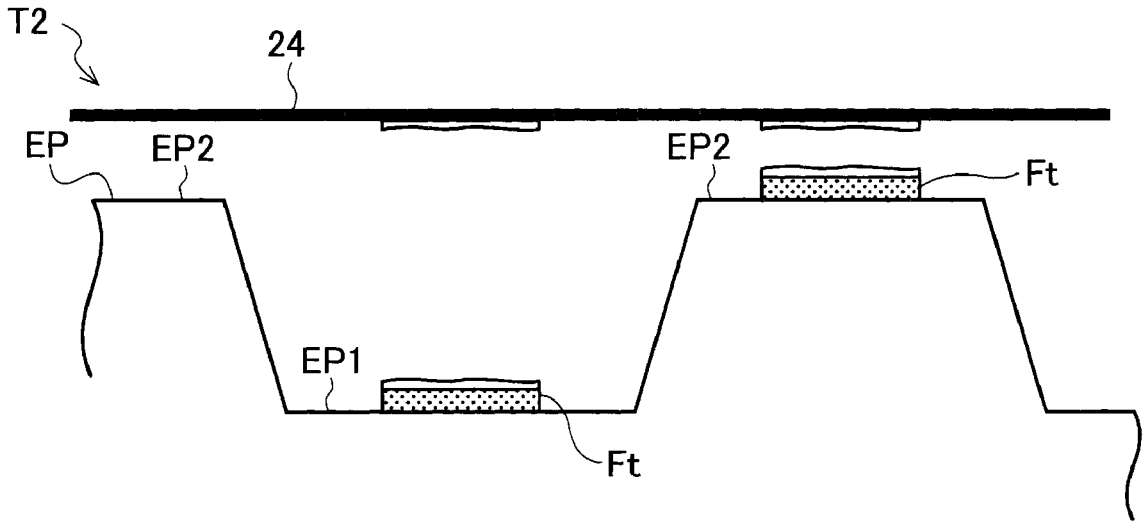
FIG. 4C is an enlarged view of the second transfer section, illustrating a state after the toner has been transferred to the embossed paper.

Then, at the position of the second transfer portion T2, the transfer electric field by the second transfer roller 36 acts on the embossed paper EP, and each toner (the toner image) on the intermediate transfer belt 24 experiences electrostatic force and is drawn toward the embossed paper EP (see FIG. 4B). At this time, the distances to the intermediate transfer belt 24 differ in a case of flat portions EP1 and in a case of protrusions EP2 of the embossed paper EP. Therefore, there is difference in the magnitude of the transfer electric field (a transfer electric field E1 at the indentation EP1 is weaker than a transfer electric field E2 at the protrusion EP2). Thus, there is also difference in the electrostatic force which draws the toner (in FIG. 4B, an electrostatic force acting on the toner at the indentation EP1 is F2, an electrostatic force acting on the toner at the protrusion EP2 is F2', and the electrostatic force F2' is greater than the electrostatic force F2). However, because the adhesion force F1 of the toner onto the intermediate transfer belt 24 is lower than in the case of the first state, as shown in FIG. 4C, the toner is excellently transferred even at the indentation EP1. That is, for the recording medium that has protrusions on the surface, such as the embossed paper EP, the transfer pressure at the first transfer portion T1 is lowered and accordingly the adhesion force of the toner onto the intermediate transfer belt 24 is lowered. Therefore, at the second transfer portion T2, the toner is excellently transferred even to the indentation EP1, and occurrences of image deletion in the outputted image are suppressed. Here, as shown in FIG. 4C, a small amount of the clear toner Lt is left on the intermediate transfer belt 24. However, because at least the colored toners are transferred onto the embossed paper EP, color reproduction characteristics of the outputted image are thoroughly assured.

Second Exemplary Embodiment

Next, a second exemplary embodiment of the image forming apparatus of the present invention will be described with reference to the drawings. Members that are the same as in the first exemplary embodiment are assigned the same reference numerals and will not be described.

Herebelow, an image forming apparatus 110 will be described. Similarly to the first exemplary embodiment, the image forming apparatus 110 is provided with the image forming units 14L to 14K of the respective colors. Given that the image forming units 14L to 14K have substantially the same structure, a first transfer device 112Y of the image forming unit 14Y is described in detail as a representative here. Of the components illustrated in FIG. 5A and FIG. 5B, letters representing colors are not given for components that are common to the colors. A first state of the first transfer device 112Y is illustrated in FIG. 5A and a second state of the first transfer device 112Y is illustrated in FIG. 5B.

Figure 5A:
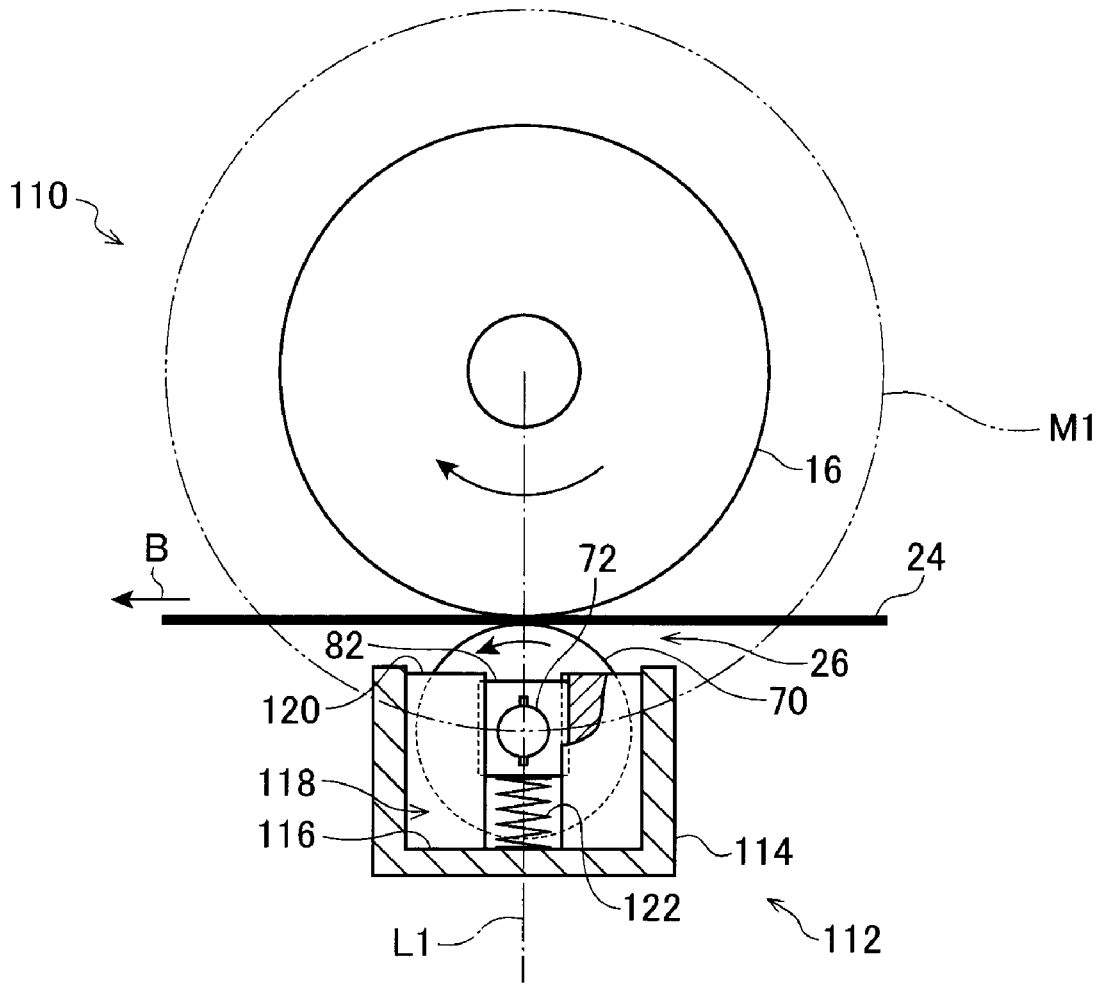
FIG. 5A is a partial sectional side view in which a first state of a transfer device of a second exemplary embodiment of the present invention is viewed from a side.
Figure 5B:
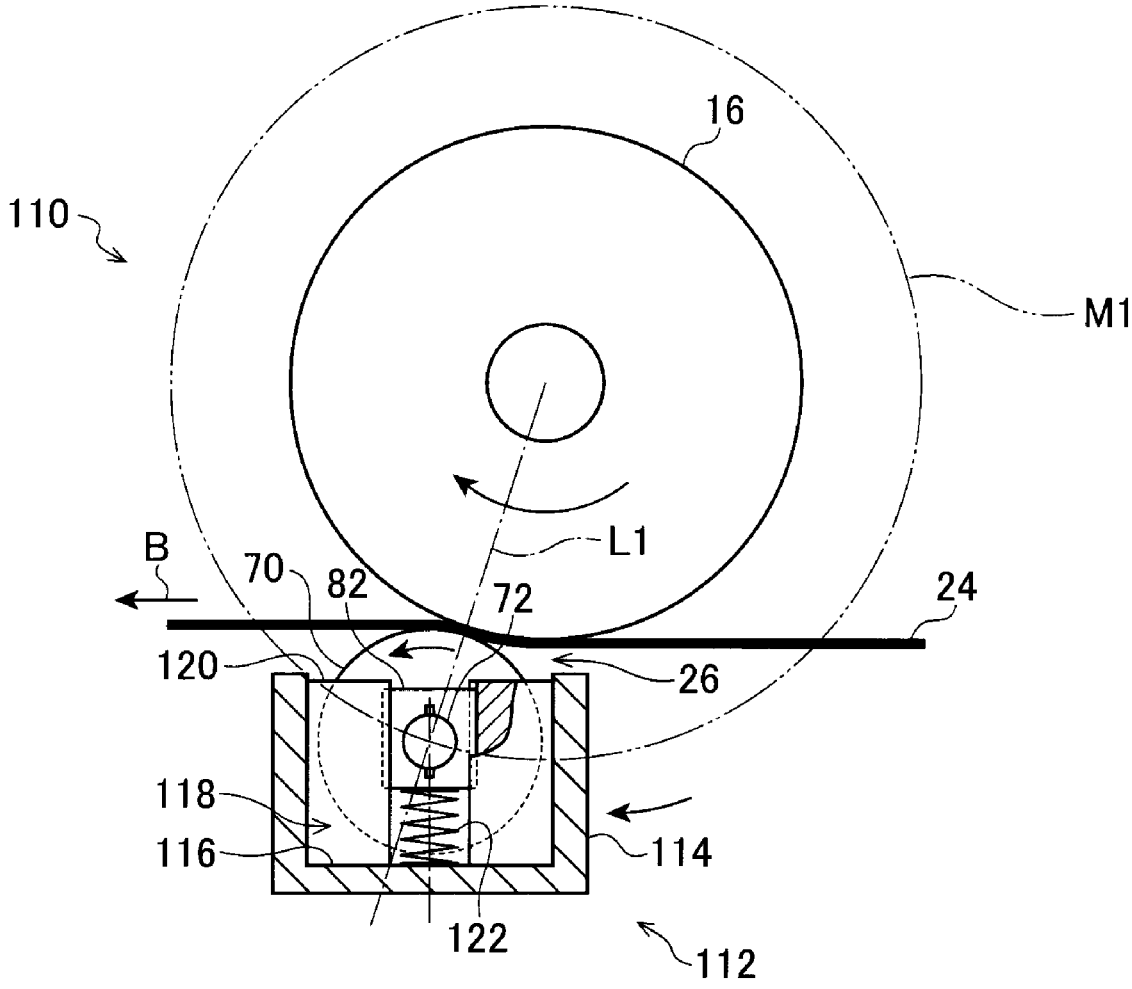
FIG. 5B is a partial sectional side view showing a side view of the transfer device of FIG. 5A.

As shown in FIG. 5A, the first transfer device 112Y includes the first transfer roller 26Y, the first transfer bias power supply 60Y, a housing 114Y and urging mechanisms 118Y. The first transfer roller 26Y is accommodated in the rectangular box-form housing 114Y, which is disposed below the photosensitive drum 16Y. The upper face of this housing 114Y is open, and the first transfer roller 26Y can be moved in and out through this opening.

The urging mechanisms 118Y are respectively attached to a floor face 116Y at the inner side of the housing 114Y at positions corresponding with the axle portions 72Y of the first transfer roller 26Y, and urge the first transfer roller 26Y upward. The urging mechanisms 118Y urge the first transfer roller 26Y upward to press the intermediate transfer belt 24 against the photosensitive drum 16Y. Below, details of the urging mechanism 118Y will be described.

Each urging mechanism 118Y is provided with the bearing 82Y, a pair of guide rails 120Y and a first coil spring 122Y. The bearing 82Y turnably supports the axle portion 72Y of the first transfer roller 26Y. The pair of guide rails 120Y guide vertical direction movements of the bearing 82Y, and are attached to inner faces of the walls of the housing 114Y. The first coil spring 122Y is disposed between the bearing 82Y and the housing 114Y, and urges the bearing 82Y upward.

The two side faces of the bearing 82Y are inserted into the pair of letter U-like shape guide rails 120Y, and the bearing 82Y is slidable. Specifically, the bearing 82Y is in a state in which the two side face portions thereof fit into the recess portions of the U shapes of the guide rails 120Y.

The guide rails 120Y extend in the vertical direction. Rear faces thereof are attached to inner faces of the walls of the housing 114Y, and lower end portions touch against the floor face 116Y of the housing 114Y.

A portion at one end of the first coil spring 122Y is attached to the lower face of the bearing 82Y, and a portion at the other end is attached to the floor face 116Y of the housing 114Y. The first coil spring 122Y is disposed such that, as viewed in the direction of illustration of FIG. 5A (a side view), the central axis of the first coil spring 122Y coincides with the straight line L1 that extends in the diametric direction of the photosensitive drum 16Y (the straight line passing through the center of the photosensitive drum 16Y and the center of the first transfer roller 26Y).

Figure 10:
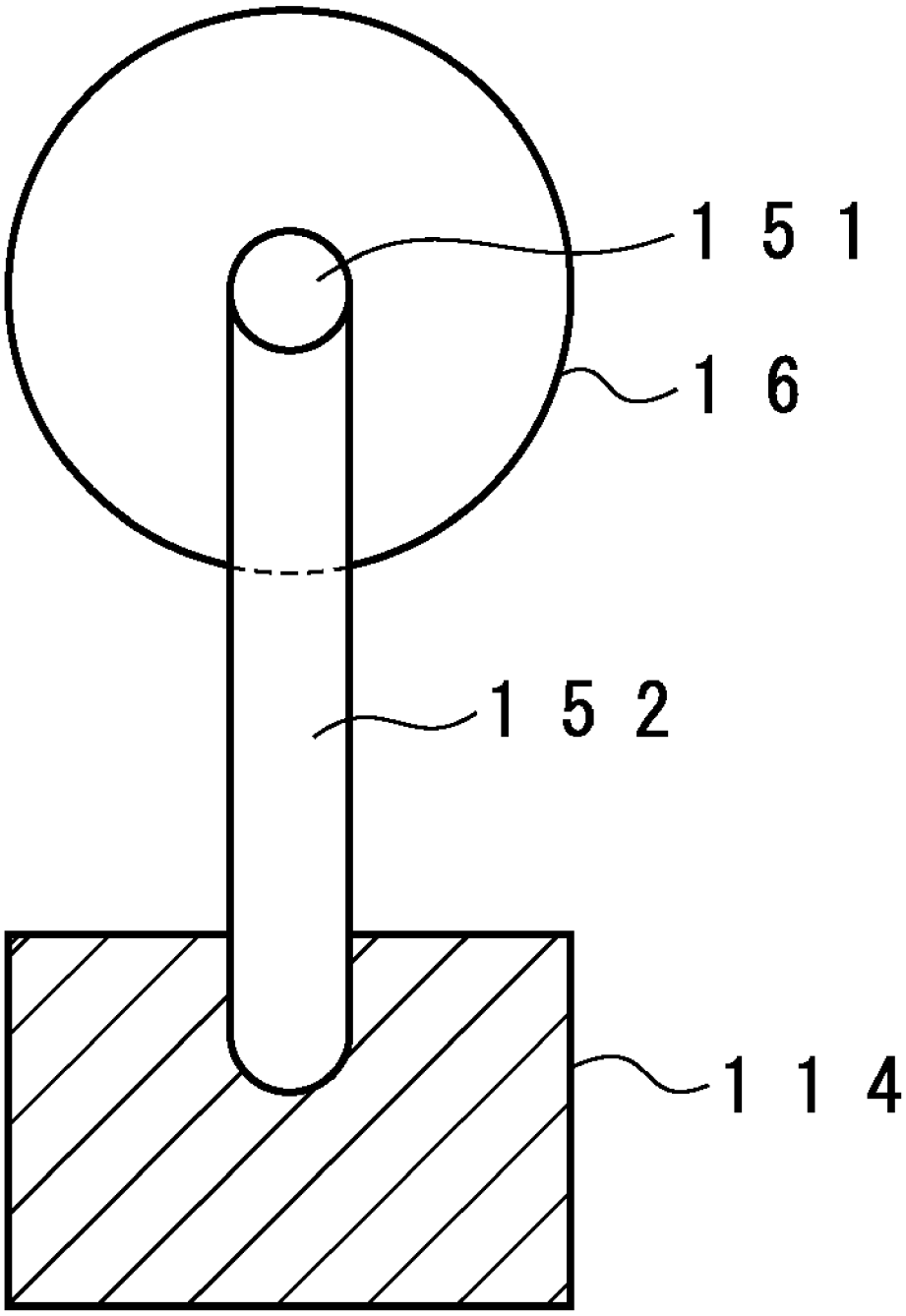
FIG. 10 is a partial sectional side view in which a transfer device of the second exemplary embodiment of the present invention is viewed from a side.

A portion at one end of an arm 152 in FIG. 10 is attached to a length direction wall face of the housing 114Y. A rotation axis of the arm coincides with the rotation axis of the photosensitive drum 16Y. This arm is turned by driving force of a motor 151 in FIG. 10, and drives the housing 114Y to turn such that the central axis of the first transfer roller 26Y moves along the line of a theoretical circle M1 that is concentric with the photosensitive drum 16Y, which is shown by a broken line in FIG. 5A and FIG. 5B. The wall face of the housing 114Y is turnably supported by the arm, and attitude control is performed such that the central axis of the first coil spring 122Y is along the vertical direction.

Now, an operation will be described in which the first transfer device 112Y switches, on receiving a control signal from the control section 30 and the arm rotating, from the first state shown in FIG. 5A to the second state shown in FIG. 5B. Here, determination of the type of the recording paper P by the control section 30 is the same as in the first exemplary embodiment.

A control signal from the control section 30 for switching the first transfer device 112Y from the first state to the second state is sent to the driving motor of the arm, then the driving motor turns the arm. Accordingly, the housing 114Y moves along the line of the theoretical circle M1.

At this time, a force with which the intermediate transfer belt 24 presses against the photosensitive drum 16Y by the first transfer roller 26Y being urged upward (pushing force) is lowered without the compression ratio of the first coil spring 122Y that urges the first transfer roller 26Y upward being altered. This is because, when the arm turns, the urging direction (central axis direction) of the first coil spring 122Y has an intersecting relationship with the straight line L1, and therefore the pressing force by the first coil spring is dispersed. Therefore, the transfer pressure at the first transfer portion T1 is lowered, and the adhesion force F1 of the toner onto the intermediate transfer belt 24 is lowered (see FIG. 4A to FIG. 4C). Consequently, the same as in the first exemplary embodiment, the toner will be excellently transferred onto the embossed paper EP, and occurrences of image deletion in the outputted image are suppressed.

Third Exemplary Embodiment

Next, a third exemplary embodiment of the image forming apparatus of the present invention will be described with reference to the drawings. Members that are the same as in the second exemplary embodiment are assigned the same reference numerals and will not be described.

Figure 6:
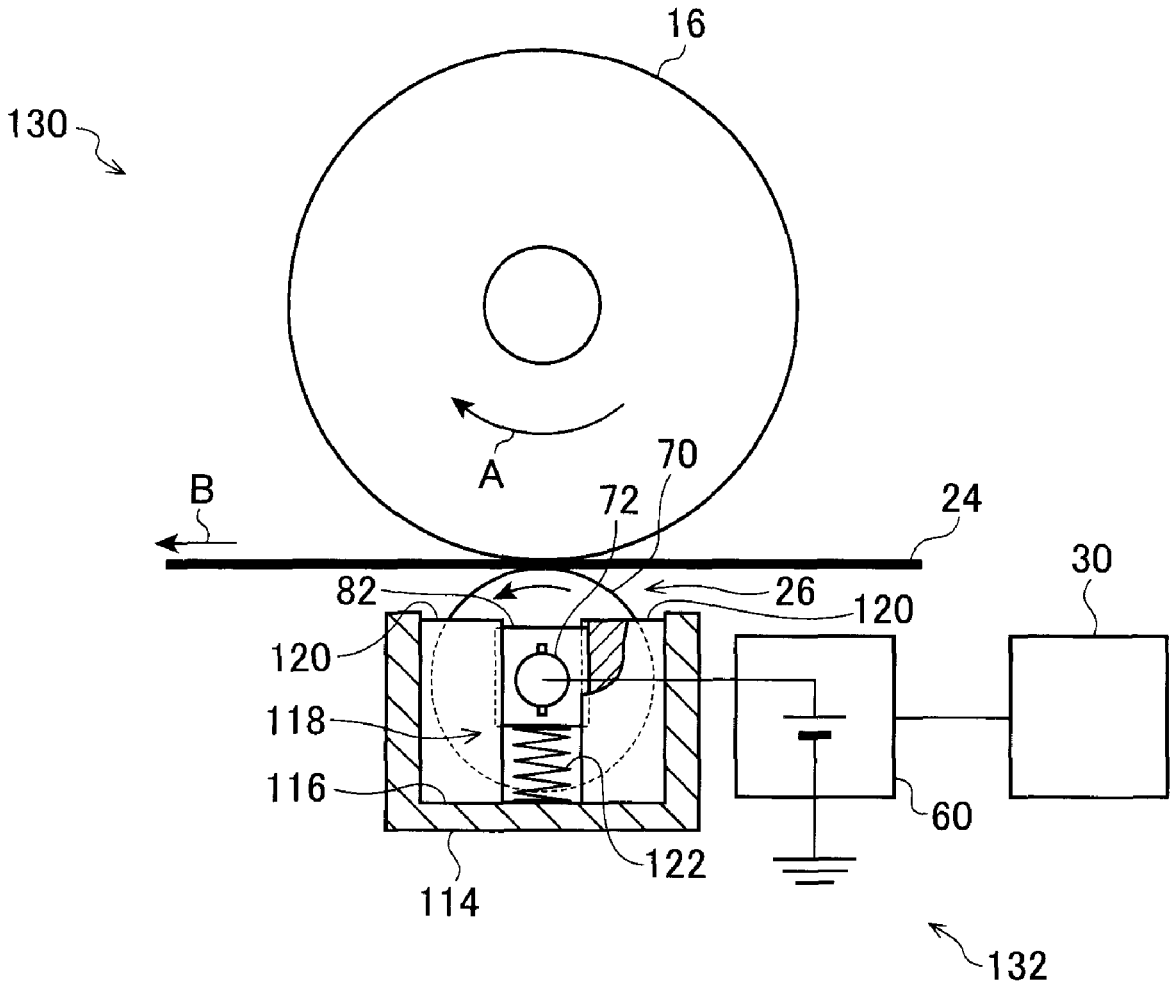
FIG. 6 is a partial sectional side view in which a transfer device of a third exemplary embodiment of the present invention is viewed from a side.

Herebelow, an image forming apparatus 130 will be described. Similarly to the second exemplary embodiment, the image forming apparatus 130 is provided with the image forming units 14L to 14K of the respective colors. Given that the image forming units 14L to 14K have substantially the same structure, a first transfer device 132Y of the image forming unit 14Y is described in detail as a representative here. Of the components illustrated in FIG. 6, letters representing colors are not given for components that are common to the colors.

At the first transfer device 132Y, the first transfer bias that is applied to the first transfer roller 26Y by the first transfer bias power supply 60Y can be altered. Specifically, when the first transfer bias power supply 60Y receives control signals from the control section 30, the first transfer bias power supply 60Y alters a transfer current flowing between the photosensitive drum 16Y and the first transfer roller 26Y (the transfer current is detected by an ammeter). The first transfer bias changes in accordance with these changes in the transfer current.

When the type of recording paper P inputted through the operation panel 64 corresponds to the embossed paper EP, the control section 30 lowers the transfer current flowing between the photosensitive drum 16Y and the first transfer roller 26Y relative to a case in which the type of recording paper P is ordinary paper. Therefore, in a case in which the type of the recording paper P is the embossed paper EP, the transfer electric field at the first transfer portion T1 is lowered, and the toner electrostatic force transferring the toner onto the intermediate transfer belt 24 is lowered. As a result, the adhesion force F1 of the toner onto the intermediate transfer belt 24 is lowered. Therefore, similarly to the exemplary embodiments described above, the toner is excellently transferred onto the embossed paper EP, and occurrences of image deletion in the outputted image are suppressed. Furthermore, in compared to the exemplary embodiments described above, the image forming apparatus 130 of the present exemplary embodiment lowers the adhesion force of the toner onto the intermediate transfer belt 24 simply by controlling the transfer current rather than using a complicated mechanism.

The exemplary embodiments described above have constitutions in which the type of the recording paper P inputted through the operation panel 64 is determined by the control section 30 and the transfer pressure or transfer electric field at the first transfer portion T1 is adjusted. However, the present invention is not necessarily limited to these constitutions. Constitutions are also possible in which the type of the recording paper P is read with an optical sensor 150 (for example, the optical sensor 150 is provided at the transport path of the recording paper P at the upstream side with respect to the second transfer portion T2), and the type of the recording paper P is determined by the control section and the transfer pressure or transfer electric field at the first transfer portion T1 is adjusted. Specifically, before the recording paper P is transferred to the second transfer portion T2, smoothness of the recording paper P is measured with an optical sensor. If the smoothness is equal to or above a reference level, it is determined that the recording paper is ordinary paper, and if lower than the reference level, it is determined that the recording paper P is the embossed paper EP. For this measurement of smoothness by the optical sensor, determination is made by light amount of reflected light. If the light amount of reflected light is large, the smoothness is high, and if the light amount of reflected light is small, the smoothness is low. The reference value of the determination is memorized in a memory of the control section beforehand.

Hereabove, the embodiments have been presented and described as exemplary embodiments of the present invention. However, these embodiments are examples, and many modifications may be applied within a scope not departing from the spirit of the invention. Obviously, the scope of rights to the present invention is not to be limited by these exemplary embodiments.

Next, results of tests performed in order to verify the effects of the present invention will be described. As shown in the table of FIG. 9, levels of image deletions at flat portions EP1 of embossed paper EP are ranked from grade 1 to grade 3.

First Transfer Load

Figure 7:
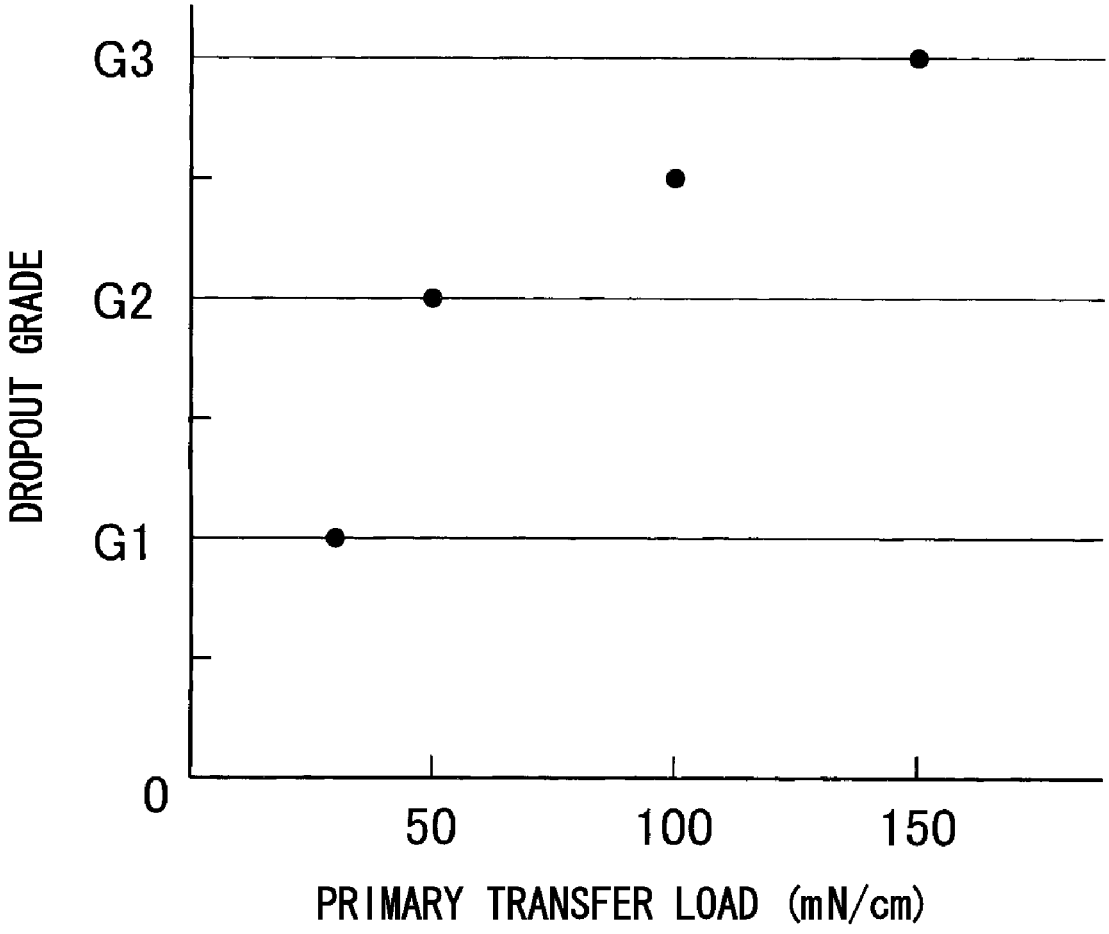
FIG. 7 is a graph illustrating a relationship between first transfer load and image deletion grades of embossed paper.

As a first test, a test is carried out in which the first transfer load (pressing force) of the intermediate transfer belt at the first transfer portion T1 is altered. Apparatuses used for this test are the image forming apparatus 10 of the first exemplary embodiment and the image forming apparatus 110 of the second exemplary embodiment. Results are shown in FIG. 7.

Firstly, in a state in which the first transfer load at the first transfer position T1 is 142 mN/cm, a line image of 1.5 mm wide and a 20 mm×20 mm solid image are formed on embossed paper with red in a toner amount of 200% and clear toner in a toner amount of 100%. In this case, transfer characteristics of the solid portion (image) are excellent, but image deletions occur only at positions of the line image that correspond to flat portions. In the flat portions, there are whitened regions, that is, the level is grade 3 (G3).

Then, in a state in which the first transfer load at the first transfer position T1 is 49 mN/cm, a line image of 1.5 mm wide and a 20 mm×20 mm solid image are formed on embossed paper with red in a toner amount of 200% and clear toner in a toner amount of 100%. In this case, transfer characteristics of the solid portion are excellent but image deletions occur only at positions of the line image that correspond to flat portions. In the flat portions, there are slightly whitened regions, that is, the level is grade 2 (G2). That is, the level of image deletions in the line image on the embossed paper is improved by lowering the first transfer load.

Finally, in a state in which the first transfer load at the first transfer position T1 is 29 mN/cm, a line image of 1.5 mm wide and a 20 mm×20 mm solid image are formed on embossed paper with red in a toner amount of 200% and clear toner in a toner amount of 100%. In this case, transfer characteristics of the solid portion are excellent, the level of image deletions at positions of the line image that correspond to flat portions is a level at which there are slightly pale regions in the flat portions, that is, the level is grade 1 (G1). That is, phenomenon of image deletions in the line image on the embossed paper is improved by lowering the first transfer load to 29 mN/cm.

First Transfer Current

Figure 8:
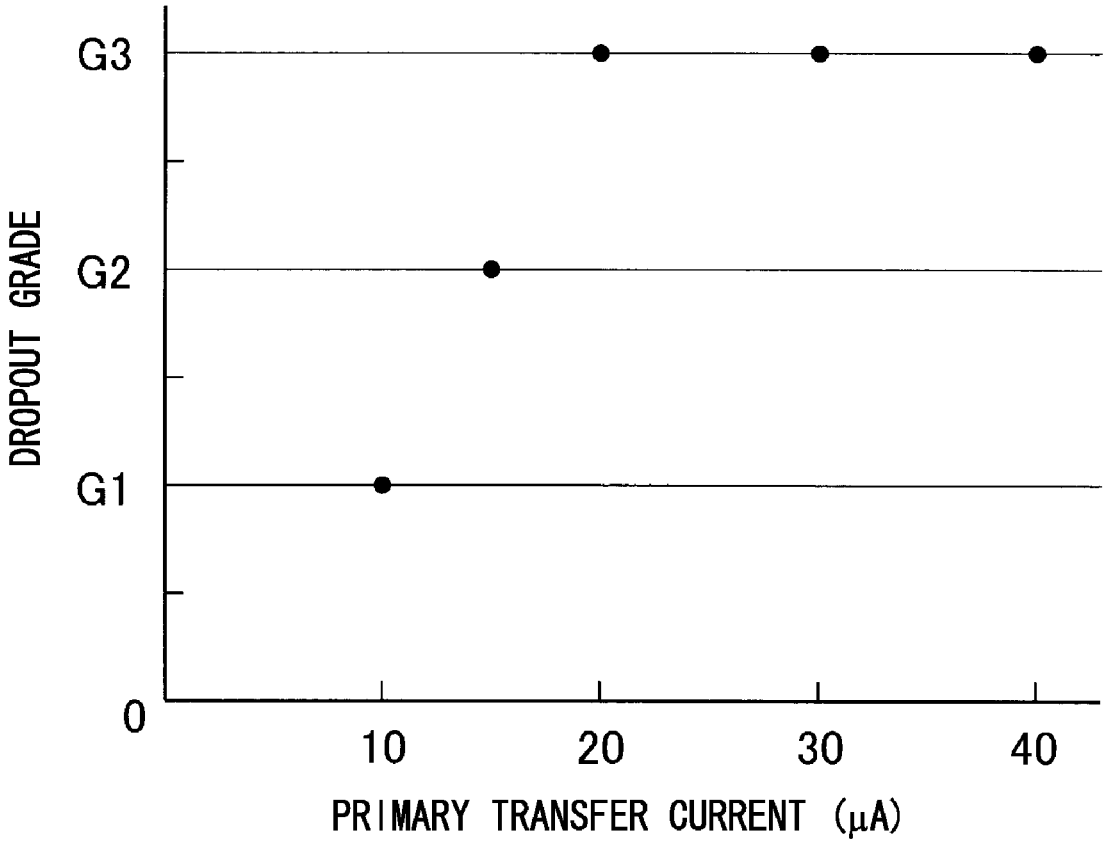
FIG. 8 is a graph illustrating a relationship between first transfer current and image deletion grades of embossed paper.

As a second test, a test is carried out in which the first transfer current flowing between the photosensitive drum and the first transfer roller is altered. An apparatus used for this test is the image forming apparatus 130 of the third exemplary embodiment. Results are shown in FIG. 8.

Firstly, in each of states in which the first transfer currents are 40 μA, 30 μA and 20 μA respectively, a line image of 1.5 mm wide and a 20 mm×20 mm solid image are formed on embossed paper with red in a toner amount of 200% and clear toner in a toner amount of 100%. In this case, transfer characteristics of the solid portion are excellent but image deletions occur only at positions of the line image that correspond to flat portions. In the flat portions, there are whitened regions, that is, the level is grade 3 (G3).

Then, in a state in which the first transfer current is 15 μA, a line image of 1.5 mm wide and a 20 mm×20 mm solid image are formed on embossed paper with red in a toner amount of 200% and clear toner in a toner amount of 100%. In this case, transfer characteristics of the solid portion are excellent and image deletions occur only at positions of the line image that correspond to flat portions. In the flat portions, there are slightly whitened regions, that is, the level is grade 2 (G2). That is, the level of image deletions in the line image on the embossed paper is improved by lowering the first transfer current.

Finally, in a state in which the first transfer current is 10 μA, a line image of 1.5 mm wide and a 20 mm×20 mm solid image are formed on embossed paper with red in a toner amount of 200% and clear toner in a toner amount of 100%. In this case, transfer characteristics of the solid portion are excellent, the level of image deletions at positions of the line image that correspond to flat portions is a level at which there are slightly pale regions in the flat portions, and the level is grade 1 (G1). That is, phenomenon of image deletions in the line image on the embossed paper is improved by lowering the first transfer current to 10 μA.

What is claimed is:

1. A transfer device comprising:

a first transfer unit that transfers a developer image formed on an image carrier to an intermediate transfer member;

a second transfer unit that transfers the developer image on the intermediate transfer member to a recording medium; and a control unit that controls a transfer pressure between the image carrier and the intermediate transfer member by the first transfer unit in accordance with a type of the recording medium to which the developer image is transferred, wherein in a case in which the type of the recording medium is a recording medium, on a surface of which a plurality of protrusions are formed, the control unit makes the transfer pressure lower than that in a case in which the type of the recording medium is a non-protrusion recording medium.

2. The transfer device of claim 1, further comprising an input unit that inputs the type of the recording medium, wherein, in the case in which the inputted type of the recording medium is the recording medium, on the surface of which a plurality of protrusions are formed, the control unit makes the transfer pressure by the first transfer unit lower than that in the case in which the type of the recording medium is the non-protrusion recording medium.

3. The transfer device of claim 2, wherein the first transfer unit includes:

a pressing member that is disposed at an opposite side from the image carrier so as to sandwich the intermediate transfer member between the pressing member and the image carrier, and presses the intermediate transfer member against the image carrier; and a voltage application unit that applies to the pressing member a transfer voltage of a polarity opposite to a polarity of the developer image, and in a case in which the inputted type of the recording medium is the recording medium, on a surface of which the plurality of protrusions are formed, the control unit makes a pressing force of the pressing member smaller than that in a case in which the type of the recording medium is the non-protrusion recording medium.

4. The transfer device of claim 3, wherein the first transfer unit includes an urging mechanism that urges the pressing member toward the side of the image carrier, the urging mechanism including:

a first urging member one end of which is disposed at the side of the pressing member to urge the pressing member, a second urging member one end of which is disposed at the side of a housing of the first transfer unit, and a base that is disposed between the first urging member and the second urging member and connects the other end of the first urging member and the other end of the second urging member, and a moving mechanism that moves the base, and the control unit makes the pressing force of the pressing member smaller by moving the base to compress the second urging member.

5. The transfer device of claim 3, wherein the first transfer unit includes an urging mechanism that urges the pressing member toward the side of the image carrier, the urging mechanism including an urging member one end of which is disposed at the side of the pressing member and the other end of which is disposed at the side of a housing of the first transfer unit, the housing is rotatable by a driving unit on a circle whose center is a rotating axis of the image carrier, and the control unit makes the pressing force of the pressing member smaller by rotating the housing to change a pressing position of the pressing member.

6. The transfer device of claim 1, further comprising a sensor that reads the recording medium to determine the type of the recording medium, wherein, based on the reading result of the sensor, in the case in which the type of the recording medium is the recording medium, on the surface of which a plurality of protrusions are formed, the control unit makes the transfer pressure by the first transfer unit lower than that in the case in which the type of the recording medium is the non-protrusion recording medium.

7. The transfer device of claim 6, wherein the sensor measures smoothness of the recording medium to determine the type of the recording medium.

8. The transfer device of claim 6, wherein the first transfer unit includes:

a pressing member that is disposed at an opposite side from the image carrier so as to sandwich the intermediate transfer member between the pressing member and the image carrier, and presses the intermediate transfer member against the image carrier; and a voltage application unit that applies to the pressing member a transfer voltage of an opposite polarity to a polarity of the developer image, and in a case in which determination is made based on the reading result of the sensor that the type of the recording medium is the recording medium, on the surface of which the plurality of protrusions are formed, the control unit makes a pressing force of the pressing member smaller than that in a case in which the type of the recording medium is the non-protrusion recording medium.

9. The transfer device of claim 8, wherein the first transfer unit includes an urging mechanism that urges the pressing member toward the side of the image carrier, the urging mechanism including:

a first urging member one end of which is disposed at the side of the pressing member to urge the pressing member, a second urging member one end of which is disposed at the side of a housing of the first transfer unit, and a base that is disposed between the first urging member and the second urging member and connects the other end of the first urging member and the other end of the second urging member, and a moving mechanism that moves the base, and the control unit makes the pressing force of the pressing member smaller by moving the base to compress the second urging member.

10. The transfer device of claim 6, wherein the first transfer unit includes an urging mechanism that urges the pressing member toward the side of the image carrier, the urging mechanism including an urging member one end of which is disposed at the side of the pressing member and the other end of which is disposed at the side of a housing of the first transfer unit, the housing is rotatable by a driving unit on a circle whose center is a rotating axis of the image carrier, and the control unit makes the pressing force of the pressing member smaller by rotating the housing to change a pressing position of the pressing member.

11. An image forming apparatus comprising:

a transfer device including a first transfer unit that transfers a developer image formed on an image carrier to an intermediate transfer member, a second transfer unit that transfers the developer image on the intermediate transfer member to a recording medium, and a control unit that controls a transfer pressure between the image carrier and the intermediate transfer member by the first transfer unit in accordance with a type of the recording medium to which the developer image is transferred;

a developer image formation unit that forms the developer image on the image carrier; and a fixing unit that fixes to the recording medium the developer image that has been transferred to the recording medium, wherein in a case in which the type of the recording medium is a recording medium, on a surface of which a plurality of protrusions are formed, the control unit makes the transfer pressure lower than that in a case in which the type of the recording medium is a non-protrusion recording medium.

12. The image forming apparatus of claim 11, wherein the transfer device further includes an input unit that inputs the type of the recording medium, wherein, in the case in which the inputted type of the recording medium is the recording medium, on the surface of which a plurality of protrusions are formed, the control unit makes the transfer pressure by the first transfer unit lower than that in the case in which the type of the recording medium is the non-protrusion recording medium.

13. The image forming apparatus of claim 12, wherein the first transfer unit includes:

a pressing member that is disposed at an opposite side from the image carrier so as to sandwich the intermediate transfer member between the pressing member and the image carrier, and presses the intermediate transfer member against the image carrier; and a voltage application unit that applies to the pressing member a transfer voltage of an opposite polarity to a polarity of the developer image, and in a case in which the inputted type of the recording medium is the recording medium, on the surface of which the plurality of protrusions are formed, the control unit makes a pressing force of the pressing member smaller than that in a case in which the type of the recording medium is the non-protrusion recording medium.

14. The image forming apparatus of claim 11, wherein the transfer device further includes a sensor that reads the recording medium to determine the type of the recording medium, wherein, based on the reading result of the sensor, in the case in which the type of the recording medium is the recording medium, on the surface of which a plurality of protrusions are formed, the control unit makes the transfer pressure by the first transfer unit lower than that in the case in which the type of the recording medium is the non-protrusion recording medium.

* * * * *